United States Patent [19]

Ingram

[11] Patent Number: 4,499,835

[45] Date of Patent: Feb. 19, 1985

[54] TUFTING MACHINES

[75] Inventor: Gary L. Ingram, Ooltewah, Tenn.

[73] Assignee: Spencer Wright Industries, Inc., Chattanooga, Tenn.

[21] Appl. No.: 493,989

[22] Filed: May 12, 1983

[51] Int. Cl.[3] ..... D05C 15/00

[52] U.S. Cl. ..... 112/79 R; 112/282; 112/DIG. 3

[58] Field of Search ..... 112/79, DIG. 3, 270, 112/280, 281, 282; 66/168

[56] References Cited

U.S. PATENT DOCUMENTS

| | | | |
|---|---|---|---|
| 2,919,566 | 1/1960 | Felker | 66/168 |
| 3,422,640 | 1/1969 | Abrams | 66/168 |
| 3,800,717 | 4/1974 | Olday | 112/282 |
| 4,305,339 | 12/1981 | Inglis | 112/281 |

FOREIGN PATENT DOCUMENTS

| | | | |
|---|---|---|---|
| 599677 | 11/1959 | Italy | 112/282 |

*Primary Examiner*—Ronald Feldbaum
*Attorney, Agent, or Firm*—Alan Ruderman

[57] ABSTRACT

A tufting machine having a lint removal system in which supply air under full shop pressure is supplied to a conduit extending the width of the machine. The conduit has a plurality of pilot air controlled valves for communicating the air in the conduit to a respective spray manifold extending across a section of the machine width. Control air is bled from the shop air and directed to a control air manifold and thence to the pilot control valves through control air valves sequenced by a stack of cams. The cams are driven in timed relationship with the tufting machine and each cam acts against a follower connected to the respective control air valve. In this manner air under full supply pressure in the conduit may be supplied to each manifold section and full supply pressure may be directed on to the gauge parts of each section.

4 Claims, 3 Drawing Figures

TUFTING MACHINES

BACKGROUND OF THE INVENTION

This invention relates to tufting machines and more particularly to a lint removal system for cleaning fibers, filaments and the like from the gauge parts, i.e., the hooks and knives, in a tufting machine.

During the operation of a tufting machine loops of yarn presented by a multiplicity of needles are seized by respective loopers or hooks and, in machines for producing cut pile fabrics, are cut by a respective knife coacting with each hook. In cut/loop tufting machines, i.e., those producing selective tufts of loop pile and cut pile, the knives act to cut selective loops. After a period of operation, and particularly where substantial amounts of cutting has occurred, loose filaments of yarn, strands of the cut yarn ends, and lint, hereafter cumulatively referred to as lint, accumulate and build up on the hook and knife gauge part. This is especially a problem when tufting spun yarns which have tiny spun filaments. Moreover, the problem is particularly significant in fine gauge machines because the lint sticks in the close space between the gauge parts and does not readily dislodge. When a significant amount of this lint accumulates on the hooks and knives, the cutting action of these elements becomes effected and cutting efficiency decreases. This eventually results in the cutting surfaces becoming dull and requiring frequent sharpening.

Consequently, it is conventional to direct air onto the hooks and knives to dislodge the lint. Known air blowing systems for these purposes provide a pipe extending the length of the machine beneath the bed. Because of the long length of a run of pipe, generally the pipe is divided into separate sections with each section supplying air to a section of gauge parts mounted in the machine. A four meter machine may have approximately ten such sections, while a five meter machine may have approximately 12 such sections. Moreover, because of the inconvenience of supplying air to the machine intermediate its length, the air is generally supplied to the machine at one end and distributed from a manifold mounted thereon. Distribution of the air to the various sections has been accomplished by using separate valves which are sequenced to supply air under full supply pressure to each section, the supply lines from the valves communicating with the respective separate sections of pipe. Thus, full supply pressure air enters a supply manifold and is directed by the appropriate valve to the respective pipe section.

Because of the length of the machine, the air fed to the sections at or adjacent the end of the machine remote from the end on which the manifold and valves are mounted must travel a relatively long distance thereby resulting in substantial pressure drop in the air supplied to these sections. Consequently, the force of the air blowing at the gauge parts remote from the manifold mounting end of the machine has been less than that desired to fully clean the lint from those gauge parts, and lint build-up on these parts may result in variations in the aesthetics of the tufts across the length of a produced fabric, and require excessive replacement of gauge parts at the remote end of the machine.

SUMMARY OF THE INVENTION

Consequently, it is a primary object of the present invention to provide a lint removal system for a tufting machine in which full air supply pressure is delivered to the gauge parts across the entire length of the tufting machine.

It is another object of the present invention to provide a lint removal system for a tufting machine in which a supply of control air is sequentially directed to amplification valves mounted in communication with a full air supply pressure manifold for opening the amplification valves in sequence to permit full air supply pressure to be communicated to sections of gauge parts in seriatim.

It is a further object of the present invention to provide a tufting machine having a lint removal system in which full air supply pressure is directed into a manifold having a plurality of pilot controlled valves, each pilot control valve being controlled by a small controlled supply of air for sequentially supplying substantially full supply pressure to the gauge parts across the entire width of the tufting machine.

Accordingly, the present invention provides in a tufting machine, a lint removal system in which supply air under full shop pressure is supplied to a conduit extending substantially the entire width of the fabric producing portion of the machine, the conduit having a plurality of pilot air controlled valves for communicating the air in the conduit to a respective spray manifold extending across a section of a width of said portion, and means for sequentially applying a supply of controlled air to each pilot air controlled valve to operate each valve and supply air under full pressure to each manifold section in sequence. In this manner air under full pressure may be supplied from the conduit through substantially the same size short length tubing to each spray manifold section. Hence, air under full pressure may be utilized to blow the lint from the gauge parts across the entire machine.

Preferably the control air is bled from the shop air inlet line and directed to a control air manifold and thence directed to the pilot control valves through control air valves controlled by a sequencing device such as a stack of cams, each cam acting against a follower connected to the respective control air valve, the cams being driven in timed relationship with the machine. Thus, only the control air tubing have varying size runs to the respective pilot control valves, and although the pressure drop in the tubing may vary, the control air pressure to each pilot control valve is sufficient to activate that valve to permit air under full supply pressure to be blown onto the gauge parts.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
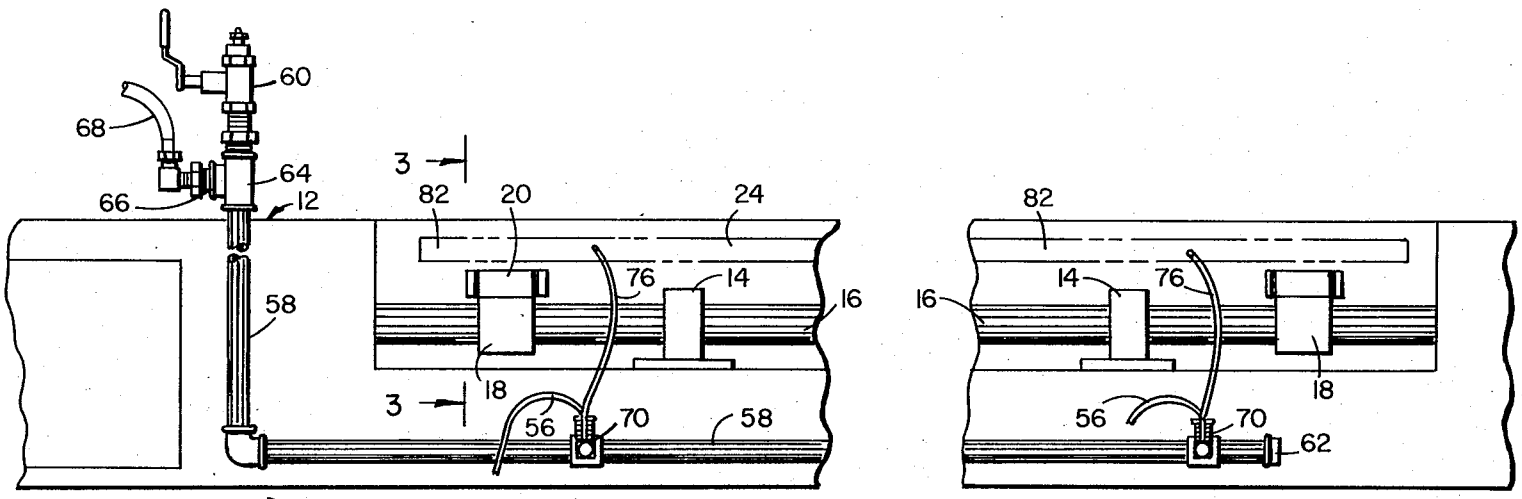
FIG. 1 is a fragmentary elevational view of a portion of the rear of a tufting machine incorporating a lint removal system constructed in accordance with the principles of the present invention.

Referring now to the drawings, in FIG. 1 a rear portion of a tufting machine 10 is illustrated having a bed 12 within which is mounted a plurality of bearing blocks 14 for journally carrying a jack shaft 16. A plurality of jack shaft rocker arms 18 are spaced across the width of the machine, each pivotably carrying one end of a connecting link 20, the other end of which is pivotably connected to the looper bar rocker arm 22. Carried by and spanning the upper ends of the rocker arm 22 is one or more looper or hook module mounting bars 24 to which a plurality of hook modules 26 are secured. Each hook module 26 carries a plurality of hooks 28 which conventionally cooperate with respective needles (not illustrated) to seize loops of yarn presented thereby. The hooks 28 also cooperate with respective knives, which for purposes of clarity of presentation, also are not illustrated. The hooks and knives cooperate to cut the closed ends of the loops and in so doing create a substantial amount of lint as aforesaid.

Figure 2:
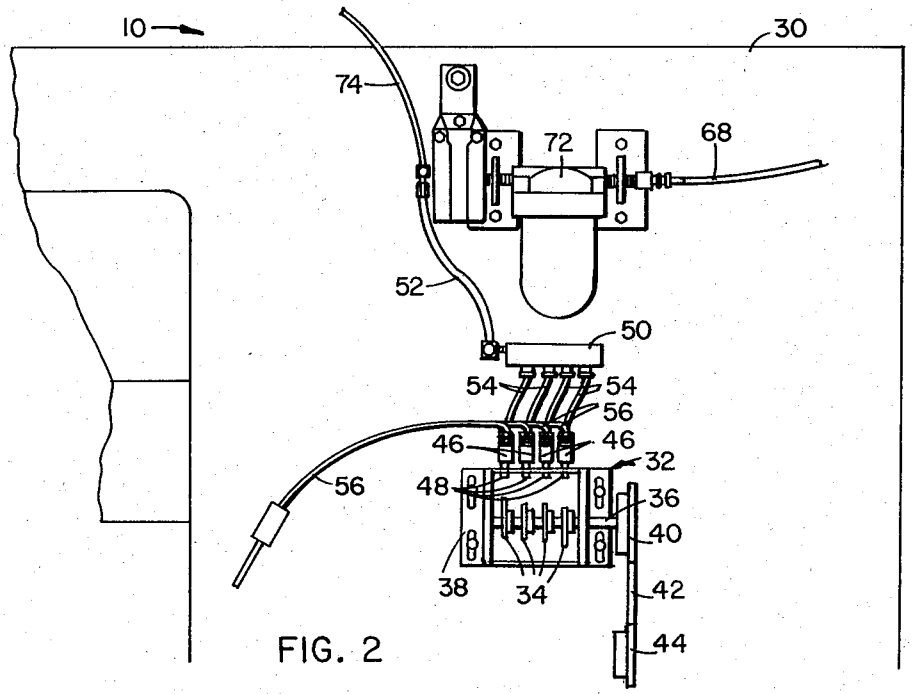
FIG. 2 is an elevational view of a portion of one end of the head at the front of the tufting machine illustrated in FIG. 1.

As illustrated in FIG. 2, mounted on the head 30 of the tufting machine, as has been the practice in the prior art, is a programmer in the form of a cam stack generally indicated at 32 comprising a series of similar cams 34 mounted on a cam shaft 36 within a housing 38 secured to the head 30. A driven sprocket 40 or the like is mounted on one end of the shaft 36 external of the housing 38 and driven by a chain 42 or the like from a drive sprocket 44 or the like which is driven in timed relationship with the looper jack shaft 16. The cams 34 correspond to respective separate sections of spray manifolds as hereinafter described, and the high point of each cam is disposed in an angularly off-set relationship relatively to the others, the angular off-set depending upon the number of cams and thus the number of separate sections of air blowing manifold. In a sample machine of two meters, four such cams 34 as illustrated are effective. Thus, each of the cams in such a stack are off-set by 90° relative to the other cams. As aforesaid a four meter machine may have approximately 10 cams and a five meter machine 12 cams, each cam being off-set by 36° and 30° respectively.

Mounted above the cam stack 32 on the housing 38 is a series of air valves 46, there being one such valve corresponding to each cam 34. Each valve 46 has a valve opening stem (not illustrated) carrying a respective cam follower 48. The followers are disposed so as to be engaged by the corresponding cam 34 when the high cam lobe or, in the case of an ecentrically mounted cam, the large radius portion of the cam is rotatably disposed adjacent to and directly beneath the respective valve 46. Mounted on the head 30 above the valves 46 is a control air manifold 50 having an air input line 52 and a plurality of outlet lines 54, one outlet line 54 corresponding to each valve for communicating the air in the manifold 50 to the respective valve. Each valve 46 also includes a respective outlet tube 56 and the air from the control air manifold 50 is communicated by each valve to the respective tube 56 upon depression of the correspohding valve stem upon engagement of a cam 34 with the respective follower 48.

In the prior art, except for a small amount of air bled for operating the brake of the machine, full shop supply air was fed to a high pressure manifold and sequentially directed through the valves 46 to each separate section of the air spraying manifold for blowing onto the gauge parts in that section. However, since the shop supply air enters at one end of the machine, the air directed to sections of the machine remote from the end at which the air is supplied undergoes substantial pressure drop resulting in insufficient pressure being available to clean the gauge parts sufficiently at and adjacent the remote end. To resolve this difficulty the present invention provides a pipe 58 having one end communicating with the shop supply air through a lever operated valve 60 and extending across the bed 12 and capped at its other end 62. Mounted at or adjacent the inlet end of the pipe 58 is a Tee connector 64 having a reducer 66 connected to its off-set leg, the reducer acting to bleed a very small portion of the full supply air to a tube 68. Since a very small percentage of the supply air is bled, substantially all of the supply air flows to the pipe 58.

Mounted in communication with the pipe 58 at spaced locations corresponding to substantially the center of each section of air blowing manifold is a plurality of control valves 70, there being one such valve corresponding to each section and thus each valve 46 and cam 34. The bled air from the tube 68 may be directed through a filter 72 and thereafter split so that it flows through two tubes, a first tube 74 communicating with the brake, and the second tube being the input line 52 communicating with the manifold 50. Thus, a very small amount of air is fed through the valves 46 and, as controlled by the cams 34, into the respective outlet tube 56.

Figure 3:
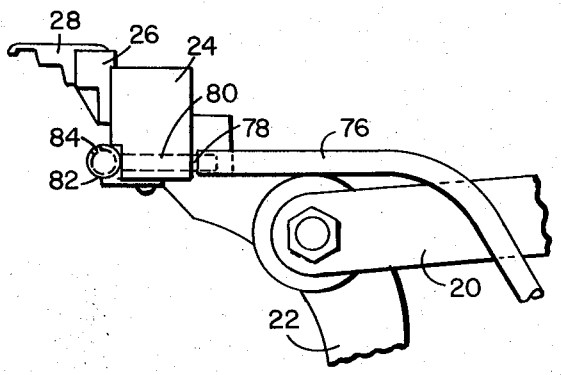
FIG. 3 is a fragmentary enlarged vertical cross-sectional view taken substantially along line 3—3 of FIG. 1.

Each control valve 70 has a pilot air actuated control member, which upon receiving a control signal comprising a small amount of air permits a large amount of air to be directed from an inlet port to an outlet port and when no signal is received shuts off communication therebetween. One such valve for accomplishing this function is manufactured by Clippard's under model No. 2012 and can be operated either normally open or normally closed, the control or pilot air effecting reversal of the normal condition. The valves 70 are connected by a nipple to the pipe 58 with the inlet communicating with the pipe 58 and the outlet of each valve is connected through a fitting with a respective tube 76. Each tube 76 is connected, as illustrated in FIG. 3, to one end of a corresponding nipple or the like 78 which in turn extends through a bore 80 in a respective portion of the hook module mounting bar 24 in each section of the machine. Connected to the other end of each nipple 78 is an air spraying manifold 82 for each section, there being one such manifold corresponding to each cam 34. Each manifold 82 includes a plurality of tiny spray holes 84 for directing the air within the manifold onto the loopers 28 and knives in that section of the machine.

The output tube 56 of each valve 46 extends through the machine and is connected to the control port of a respective valve 70 to control the control member therein. When a valve 46 is opened by the action of the corresponding cam 34, the control or pilot air from the manifold 50 is directed to the respective valve 70 thereby opening communication between the pipe 58 and the corresponding section of manifolds 82. Consequently, although a small amount of air is controlled by the cams 34, air under full shop pressure may be sprayed from each conduit 82 irrespective of the location of the section in the machine. Since the tubes 76 are of substantially the same length, the conduit in each section receives substantially the same pressure from the pipe 58, i.e., substantially the full shop supply pressure.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a plurality of oscillating gauge parts divided into a number of sections extending transversely across the machine, a lint removal apparatus for blowing air from a high pressure supply onto said gauge parts to remove the lint from the gauge parts in each section, said apparatus comprising pipe means communicating with said supply for receiving air therefrom and having a portion extending transversely across said machine, a bleed air manifold, means for bleeding a small amount of the supply air from said pipe means to said manifold, a plurality of first valves corresponding in number to said number of sections, each of said valves having an inlet, an outlet and control means for communicating said inlet with said outlet, conduit means communicating said manifold with the inlet of each first valve, programmer means for driving the control means of the first valves in seriatim such that air from the manifold flows through the outlets of all the first valves in seriatim, a plurality of pilot air operated valves corresponding in number to said number of sections, each valve having an inlet communicating with said pipe means, an outlet and a control air port, means communicating the outlet of each first valve with the control air port of a corresponding pilot air operated valve, a plurality of air spraying manifolds corresponding in number to said number of sections, each spraying manifold being disposed adjacent to a corresponding section of gauge parts and having a plurality of spraying openings for directing air therein onto the gauge parts in that section, and conduit means communicating the outlet of each pilot air operated valve with a respective air spraying manifold, whereby when bleed air flows through the outlet of the first valve the corresponding pilot air operated valve permits the air from said pipe means to be sprayed onto a corresponding section of gauge parts.

2. In a tufting machine as recited in claim 1, wherein said control means of each first valve is depressable to open communication between the inlet and the outlet, and said programmer comprises means for sequentially depressing the control means of the first valves in seriatim.

3. In a tufting machine as recited in claim 2, wherein said programmer comprises a cam stack having a plurality of cams, means for rotatably driving said cams in timed relationship with the oscillation of said gauge parts, each cam corresponding to one of said sections, a follower means for each cam, means connecting each follower means to said control means of a respective first valve, each cam having a configuration and being disposed for engaging its corresponding follower means during a portion of the rotational cycle of the cams for communicating the inlet with the outlet of the corresponding first valve only during that portion of the cycle, and the engagement of each cam with its follower being during a different portion of the cycle from the other cams.

4. In a tufting machine as recited in claim 3, wherein each portion of said rotational cycle is no more than the total cycle divided by the number of cams in said stack.

* * * * *